US006443068B1

(12) United States Patent
Meister

(10) Patent No.: US 6,443,068 B1
(45) Date of Patent: Sep. 3, 2002

(54) AMMUNITION BODY, A METHOD FOR INSERTING, AND ITS USE

(75) Inventor: Jurg Meister, Steffisburg (CH)

(73) Assignee: Ruag Munition, Thun (CH)

( * ) Notice: Subject to any disclaimer, the term of this patent is extended or adjusted under 35 U.S.C. 154(b) by 0 days.

(21) Appl. No.: 09/674,737

(22) PCT Filed: May 3, 1999

(86) PCT No.: PCT/IB99/00793

§ 371 (c)(1),
(2), (4) Date: Nov. 3, 2000

(87) PCT Pub. No.: WO99/57503

PCT Pub. Date: Nov. 11, 1999

(30) Foreign Application Priority Data

May 4, 1998 (EP) ..... 98201431

(51) Int. Cl.[7] ..... F42B 1/028
(52) U.S. Cl. ..... 102/308; 102/306; 102/307
(58) Field of Search ..... 102/306, 307, 102/308, 309, 310, 476, 503, 319

(56) References Cited

U.S. PATENT DOCUMENTS 4,590,861 A * 5/1986 Buegiel ..... 102/501
5,349,908 A * 9/1994 Walz et al. ..... 102/307
5,744,747 A * 4/1998 Renaud-Bezot et al. .... 102/476
5,753,850 A * 5/1998 Chawla et al. ..... 102/307
6,095,258 A * 8/2000 Reese et al. ..... 175/4.54

FOREIGN PATENT DOCUMENTS

FR 1531538 * 7/1968 ..... 102/476
GB 1051407 * 12/1966 ..... 102/476

* cited by examiner

*Primary Examiner*—Charles T. Jordan
*Assistant Examiner*—Gabriel Sukman
(74) *Attorney, Agent, or Firm*—Schweitzer Cornman Gross & Bondell LLP

(57) ABSTRACT

Hollow charges are often used for combating moving, lightly armored targets and do not fulfill their task due to relatively small effective charges which arrive at the target. When using blasting charges for civilian purposes, large borings must often be made at inaccessible positions without substantially affecting the environment. A shape charge (8) having a lining (3) which explodes outward in the axial area thereof punches an overcalibrated opening in the target area. A large effective charge (7) or other elements can be inserted through said opening. According to the invention, the delayed ignition of a large effective charge (7) results in a massively increased effect thereof in the target. The ammunition body (1) is provided for use predominantly in combating moving, lightly armored targets, but can also be used for oil exploration and delivery.

13 Claims, 6 Drawing Sheets

AMMUNITION BODY, A METHOD FOR INSERTING, AND ITS USE

The present invention relates to an ammunition body.

BACKGROUND OF THE INVENTION

Two stage warheads, also called tandem warheads, are used amongst other things against relatively thin armour plating and cabins having delicate contents, for example helicopters, aeroplanes and ships. The preliminary charge used here belongs to the so-called projectile-fanning charges (self-forging fragments) and has the task of punching or boring as large a hole as possible in the target.

A warhead having a tandem charge is disclosed inter alia in EF-AI-O 583 642 and is integrated in a bazooka to combat an opponent who has taken cover. The protective wall or barricade, for example, is shot through by a hollow charge; a follow-up charge generates splinters behind the cover. In the case of hard targets, ignition at the cover is effected by way of piezo igniters and, in the case of soft targets, by means of proximity igniters. The follow-up charge essentially has to be initiated after a time delay in order not to endanger the gunner, amongst other reasons. These warheads are disadvantageous in that the second charge, or follow-up charge, has to have a relatively small calibre in order to be able to penetrate into the target area. Accordingly, it can only have a limited effect in the actual target. Likewise, owing to the relatively small effective body, a use-dependent time delay is necessary for this latter to be ignited as near as possible to the actual target to be destroyed or affected.

Warheads of this type are therefore unsuitable for targets with redundant devices such as for example helicopters or ships, since their limited effect is either compensated by a back-up system and/or is additionally reduced or even eliminated by an inner bulkhead.

GB-A-I,051,407 discloses an armour piercing shell having two charges. To achieve an overcalibrated hole, a preliminary charge having a projecting rotationally symmetrical lining is proposed. An effective charge arranged downstream should be able to penetrate easily arid deeply into the target through this hole. Practical tests and computer simulations have shown however that this does not work since the resulting ring-shaped and collapsed hollow charge beam widens greatly before the target and loses its cutting effect. By comparison with conventional hollow charges, the arrangement reduces the penetration force rather than increasing it. Moreover, its force is largely angle-dependent, that is to say an oblique-angled strike of the ring-shaped, wide beam leads to its deflection in the target and demonstrates no useful effect.

Similar results can also be observed in the case of a hollow charge according to the exemplary embodiments of FR-E-73 306. Here, the discontinuities and the steep gradients in the lining profile have a particularly negative effect; these linings collapse. The maximum achievable borehole diameter is not larger than that of the notorious conical or bell-shaped linings. Shaped charges are also known (U.S. Pat. No. 2,809,585) in which inert bodies are arranged downstream of the lining of the conical preliminary charge, said inert bodies on the one hand guiding the detonation waves and on the other hand preventing the follow-up charge or the projectile downstream from being adversely influenced by the detonation face of the preliminary charge. [This known charge at the same time displays the features according to the precharacterising clause of the process claim 10.] The subject-matter results in improved system reliability but can only be used for the follow-up charges illustrated which are small with respect to the preliminary charge. Here too, the borehole achieved by the preliminary charge is only approximately the conventional 0.4 times the calibre of the preliminary charge.

A further hollow charge having one or more conically projecting linings is disclosed in U.S. Pat. No. 5,663,475. This hollow charge is principally intended for applications within oil exploration and delivery. Here, the explosive charge and the hollow charge are located in a solid guide anvil which serves to guide the beam. This arrangement produces bores in the target which are smaller than the calibre size and tends to result in extensive power losses as a result of the external beam control, which has a negative effect on the penetration depth of the ring-shaped beam.

A spherical lining characterised by three radii is described in U.S. Pat. No. 5,320,044. This lining is intended to generate two beams, a leading and a lagging beam, in order to achieve deeper penetration in the target. The necessary acceleration of the lining is effected by an overdimensional, large calibre explosive charge, the diameter of which projects by a multiple beyond the lining. The bore which may be achieved in the target is consequently only a fraction of the calibre of the explosive charge.

BRIEF DESCRIPTION OF THE INVENTION

It is therefore the object of the invention to provide an ammunition body which can create an overcalibrated bore in the target and, where necessary, delivers a large effective charge into the target. It should be possible to use the ammunition body for combating transport or fighter helicopters or in torpedoes against underwater or surface targets. Here, the opening in the target created by the preliminary charge is intended to clear the path for a large effective charge and should not impede this latter.

It should also be possible to use the subject-matter of the invention for civilian purposes, in particular in poorly accessible places where, owing to limited space, the application of conventional drilling methods is either impossible or is very time consuming and expensive in terms of materials.

This object is achieved by an ammunition body and a process for using it, wherein the ammunition body has a shaped preliminary charge with a ductile metal front lining extending across the entire front face of the charge. The lining is rotationally symmetrical about a central axis and is continuous between a periphery of the lining and an axial region, the gradient of the lining not exceeding the absolute value of 0.9.

The inventive construction of the preliminary charge has the surprising effect that the borehole it creates is larger than the calibre of the preliminary charge itself, without the penetration force (bore depth) being significantly smaller than that of conventional cutting charges. As a result, one or more effective charges can be connected in series, these having a high explosive effect or other properties which are effective in combating the specific target.

As a result of its ignited charge, the lining as such becomes a stable projectile in the form of a fragmented, greatly widened ring, which, owing to its size, flies past any components such as sensors and/or electronics which may be arranged upstream, and therefore does not cause them to cease operating prematurely.

The shape of the projecting lining, also called an insert, differs from that known in the specialist literature; the basic literature on hollow charges assumes that a lining has to be of a concave construction, that is to say not conical or bell-shaped, in its axial region.

The lining according to the invention is made of those ductile materials, such as aluminium, iron, electrolytic copper, lead or tantalum, which are known per se for this purpose, and punches out an overcalibrated disc in the target, through which one or more large effective charges can penetrate deeply and without difficulty, that is to say without extensive kinetic losses.

The invention may utilize a distance igniter, which covers any form of proximity igniter, in the simplest case a double cover having an inner contact triggering the igniter on impact against the target. In the case of stationary applications, for example for civilian purposes, this means ignition at a distance (stand-off) of at least one calibre from the target or from the surface in which a bore is to be produced.

Upon striking the target, a lining constructed in accordance with the invention acts as a greatly-accelerated cutting ring whereof large-surface fragments rotate into the ideal orthogonal position with respect to the target during their flight and penetrate said target with great-energy. In practice, in a manner analogous to punching in metal processing, a circular blank having an inner disc which is completely separated from the surrounding area is produced in the target.

The resulting differential acceleration of the cutting ring is only minimally affected by an oblique striking angle and produces a high penetration force even at large distances from the target.

For military purposes, the subject-matter of the invention relates in particular to tandem or multiple warheads.

The ammunition body of the invention with a projecting axial region produces a favourable beam form, so that a widened cutting ring is created.

A lining having an axial region thickness greater than peripheral region thickness, and having a spherical three-dimensional shape, is favourable. The lining may also be constructed with the same or different radii of curvatures for the front and rear surfaces of the lining to define further advantageous embodiments.

The incorporation of linear surfaces of revolution may be likewise advantageous.

As a result of including inert bodies, it is possible to additionally optimise the effect of the detonation wave on the lining.

A maximum effect in the target is produced by connecting in series effective charges having different characteristics, for example charges which first of all have a gas pressure effect and then form splinters.

The process of using the inventive ammunition body comprising the ignition of a preliminary charge at a distance of 2 to 10 times the calibre of the ammunition body, followed by generation of a cutting beam by the line to create a bore in the target of a diameter of 1.0 to 2.2 times the calibre leads to optimum use of the ammunition body [according to the invention] and can be adapted to special targets to be combated; for example in that the follow-up effective charges make full use of the opening created by the preliminary charge, and all the charges are adapted to each another, the armour plating and the actual effective depth required in the target.

The delayed ignition of the effective charge, which is known per se, is particularly effective in increasing the combat force, since said effective charge can penetrate through the large opening created by the preliminary charge and well into the target with a high degree of kinetic energy. Here, it is readily possible to make full use of the total diameter of the calibre of the effective charge.

The ammunition body is preferably utilized for combating relatively lightly armoured targets, such as helicopters. It also can be used in numerous civilian applications in particular in connection with the exploration, delivery and transport of minerals and pumpable media.

BRIEF DESCRIPTION OF THE DRAWINGS

Exemplary embodiments of the invention are described in more detail below, with reference to the drawings, in which.

DETAILED DESCRIPTION OF THE INVENTION

Figure 1:
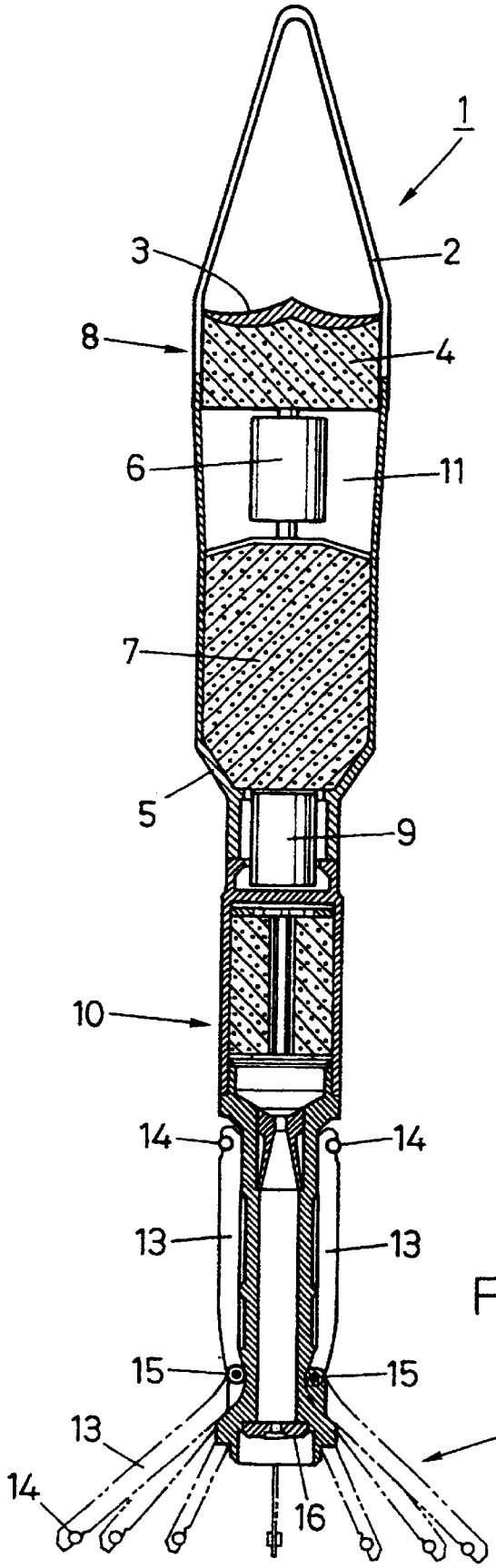
FIG. 1 shows an ammunition body having a tandem charge.

In FIG. 1, 1 denotes a projectile having a tandem warhead. This projectile 1 has a double cover 2 which is known per se and which, upon striking the target forms an electrical connection to create an ignition circuit.

A preliminary charge 8 has a specially shaped lining 3 which is accelerated by a closely fitting explosive charge 4. Downstream thereof, a conventional first ignition system 6 is placed in an intermediate space 11 in the ammunition body 1. Downstream, there is an effective charge 7 which is optimised to a high gas pressure effect and has splinters stored in its matrix. The effective charge 7 is the full calibre of the projectile and terminates in a conical tapered portion 5.

The effective charge 7 is ignited by a second ignition system 9 whereof the delay time may be programmed according to the target.

A solid-matter propulsion unit 10 of a known construction is used as the drive. Open-out guide vanes 13 having slide rollers 14 can be inserted centrally in a launcher tube (not illustrated); 15 denotes the corresponding axes of rotation. A circular deflector plate 16 serves to protect the tube and is expelled after the propulsion unit 10 has been ignited.

In the raised position, after launching, the guide vanes 13 are in the shape of a rayed guide unit 12, as indicated in the drawing. This guide unit 12 prevents the ammunition body 1 from rotating (spinning) and thus ensures an optimum cutting effect of the shaped charge in the target, a hole of 1.5 times the diameter of the calibre here being punched out of a steel plate having a thickness of 0.15 calibre. The inner disc which is accelerated in the flight direction is produced with a diameter of 1.0 times the calibre.

The follow-up effective charge 7 can therefore penetrate into the target with its full calibre in unimpeded manner and even penetrate through small bulkheads using its inherent kinetic energy and induce a substantial pressure and splinter effect there on delayed ignition.

Characteristic delay times between initiating the preliminary charge and a follow-up effective charge are 2.0 ms to 10 ms depending on the cruise speed of the propulsion unit.

Possible constructions of the lining according to the invention can be seen in the subsequent FIG. 2 to FIG. 7, the same operational parts being provided with the same reference numerals.

Figure 2:
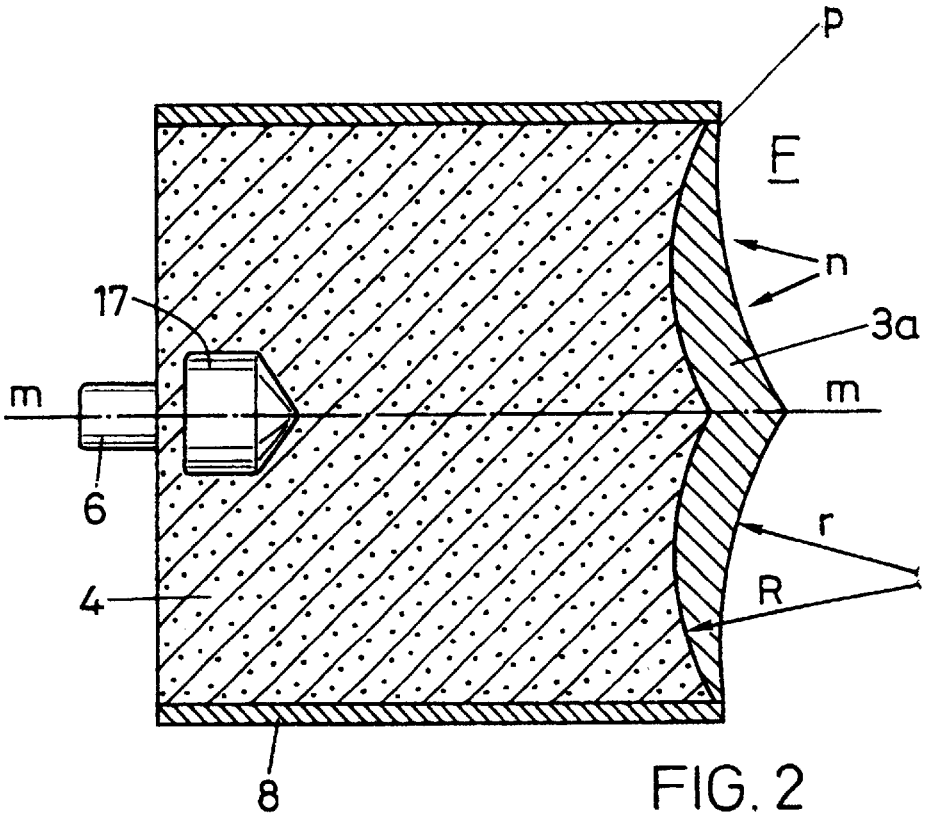
FIG. 2 shows a lining as it is used in the preliminary charge according to FIG. 1.

The schematically illustrated preliminary charge 8, FIG. 2, is likewise rotationally symmetrical and has at its front end a spherical lining 3*a* of aluminium. It can also be described as having an annular scalloped shape. R and r denote the radii of the scalloped portions, whereby R=0.85 calibre and r=0.75 calibre.

The explosive is initiated in notorious manner by an igniter 6 having a likewise known inert body (wave shaper) connected downstream for guiding the detonation face in the axial region m.

The fixing point of the lining is denoted by p in FIGS. 2 to 7 and corresponds to its peripheral edge region.

Figure 3:
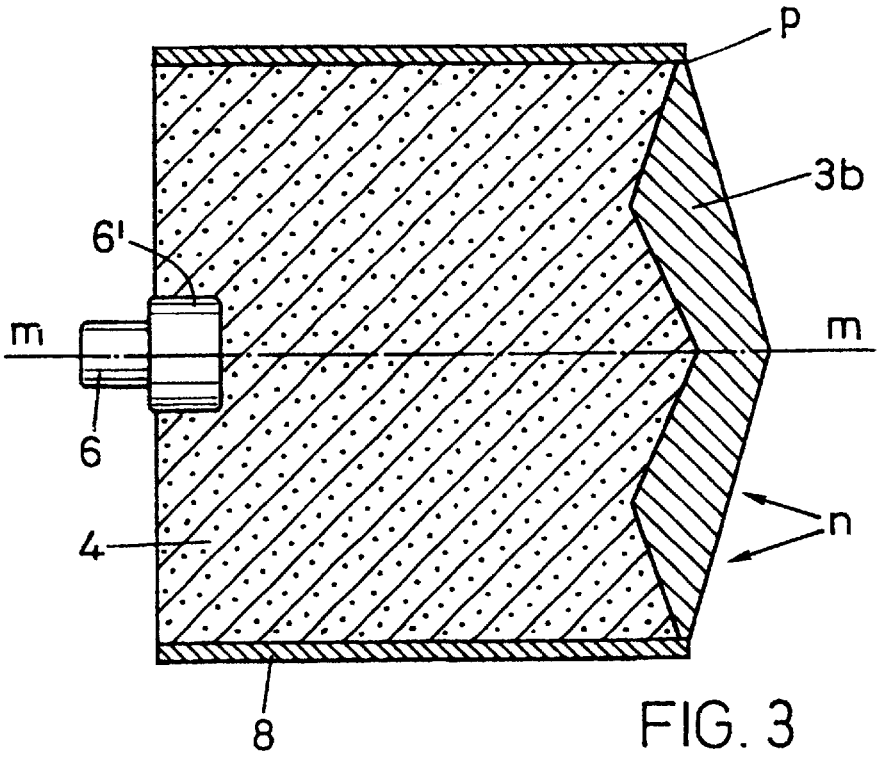
FIG. 3 shows a variant of the lining in FIG. 2.

Deviating from FIG. 2, the lining 3*b* in FIG. 3 is formed by planar faces and in this variant is made of an alloy of lead with 12% tin. The lining 3*b* likewise projects in the axial region with respect to the adjacent coaxial region n.

Instead of an inert body, here there is an ignition reinforcer 6' connected downstream of the igniter 6.

Figure 4:
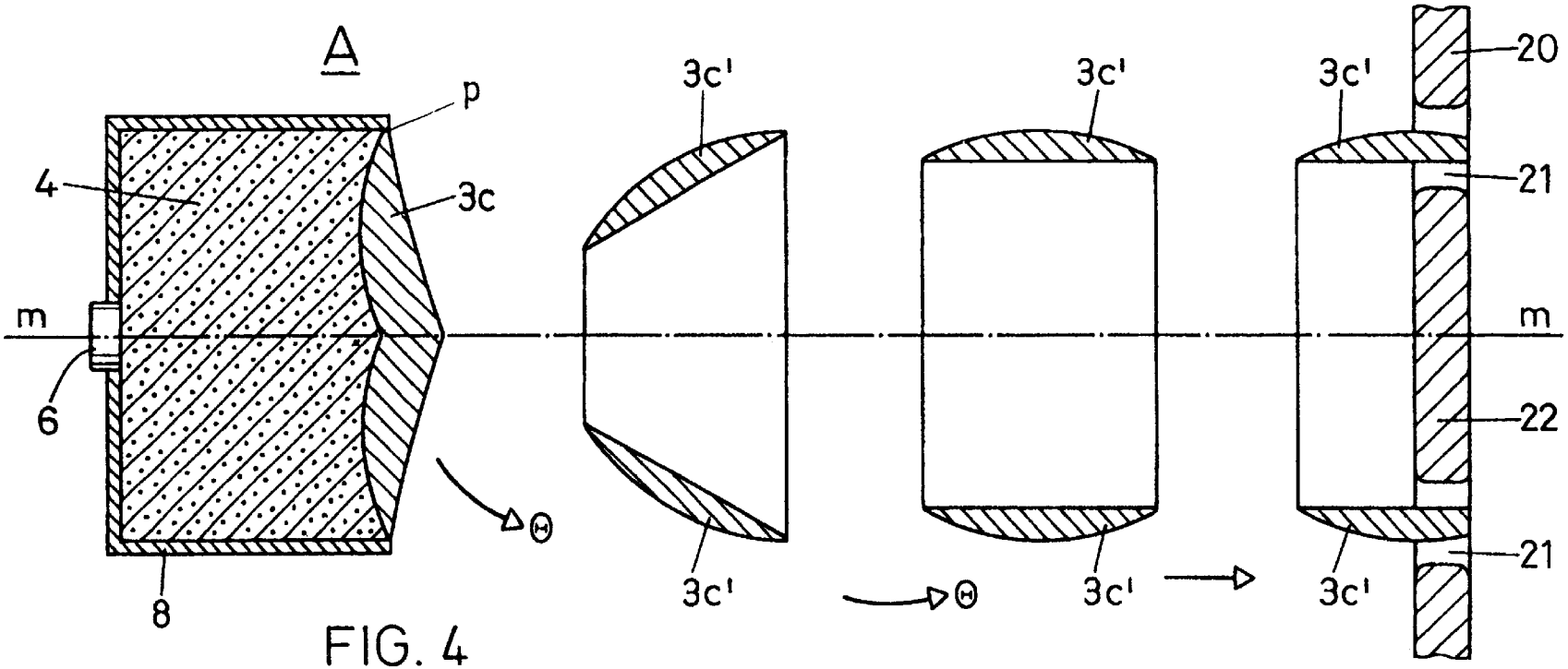
FIG. 4 shows a stylised variant of a lining, snapshot-style, during use.
Figure 5:
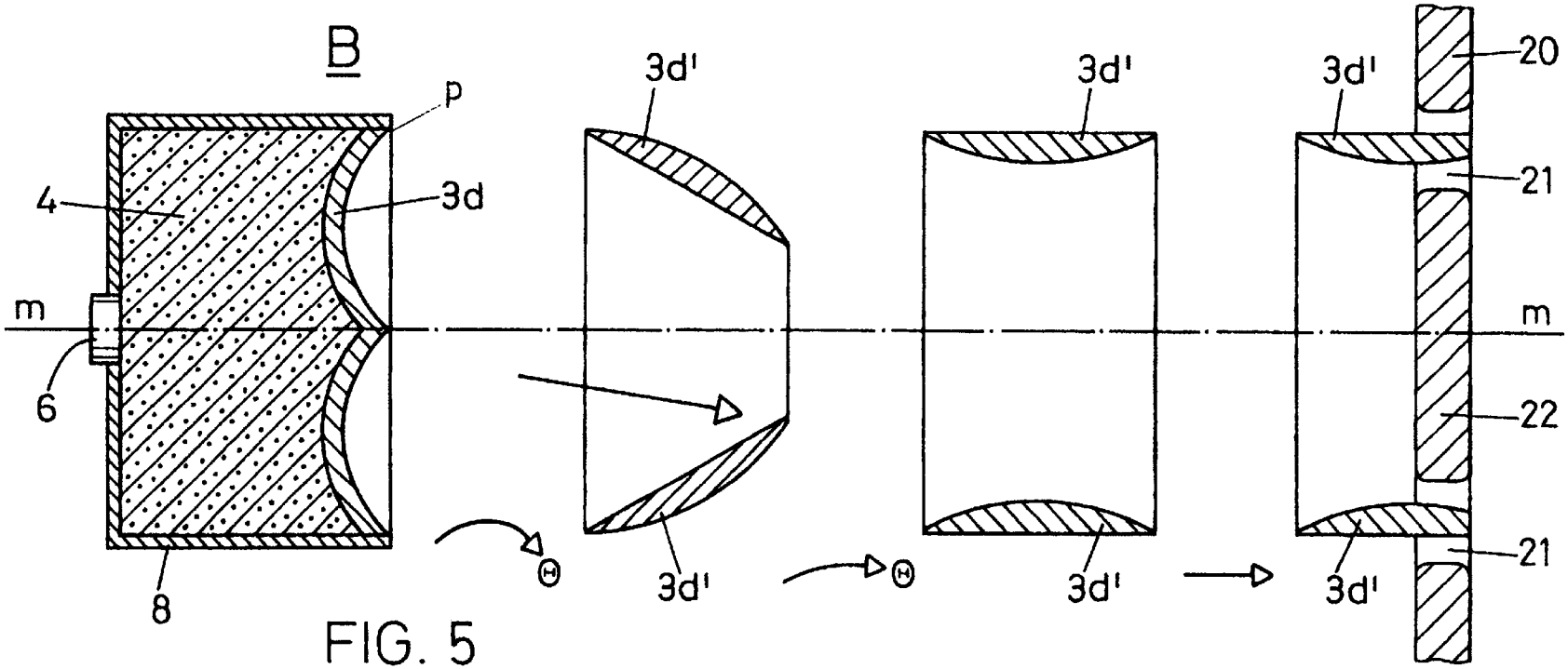
FIGS. 5 to 7 show three further stylised variants of lining, snapshot-style, during use.
Figure 6:
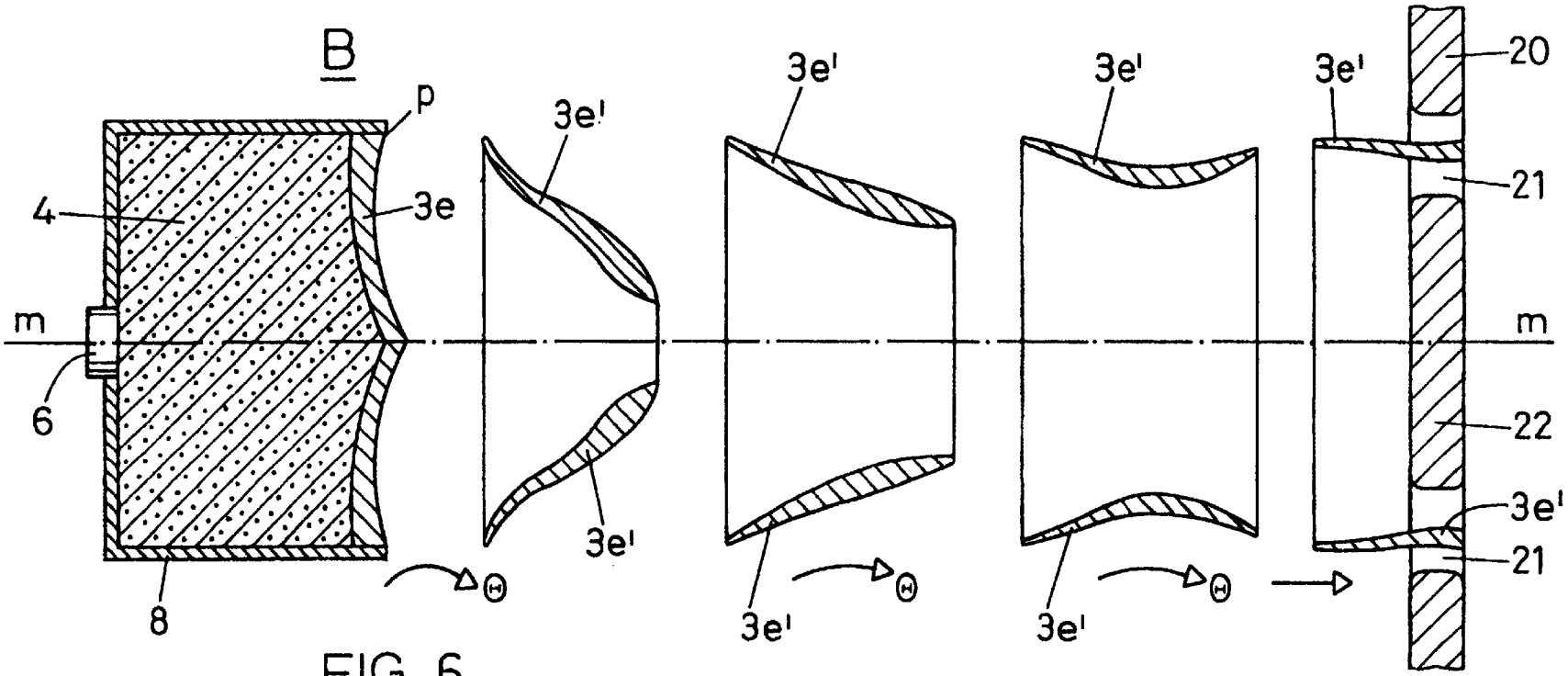
Figure 7:
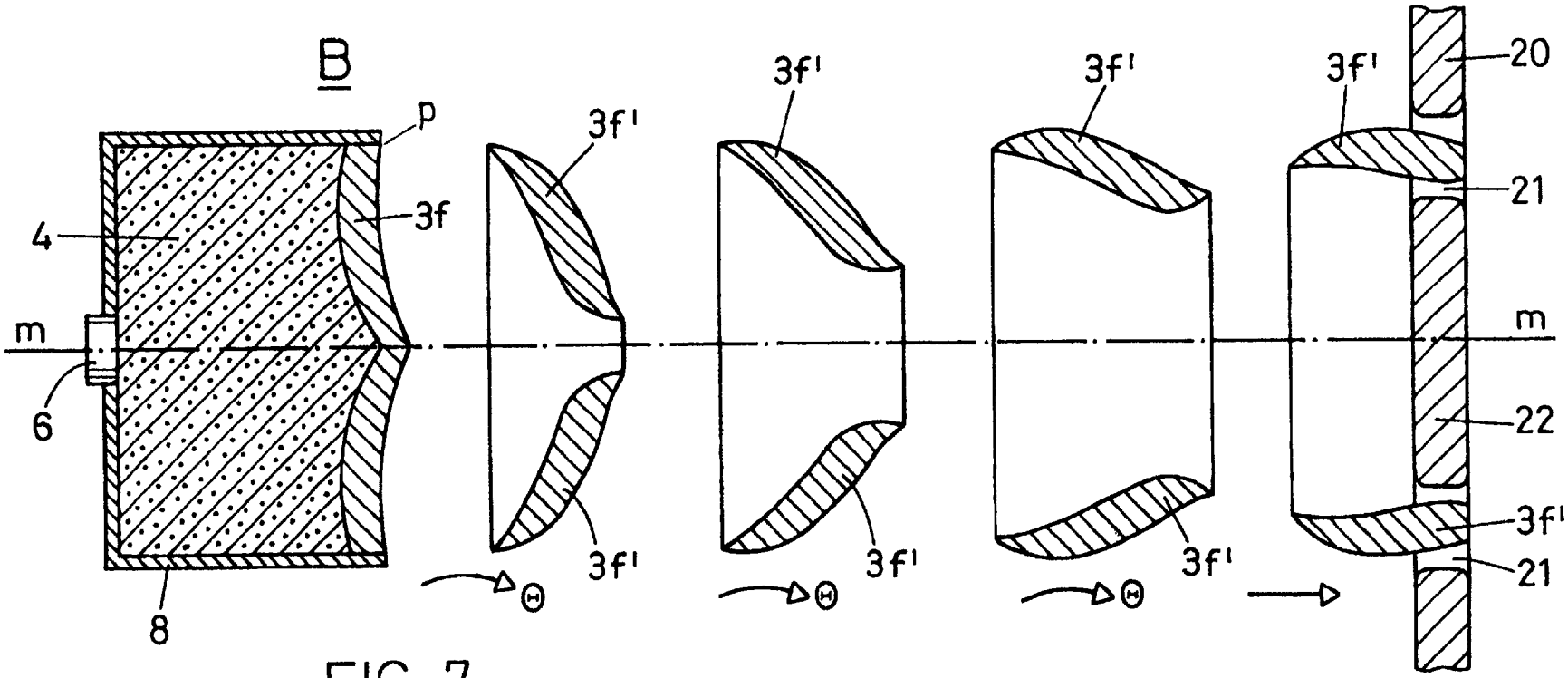

The schematically illustrated preliminary charges 8 are shown in stylised manner in FIGS. 4 to 7, the variant in FIG. 4 being denoted by A and representing linings 3*c* which are thicker in the axial region m. The variants B, FIGS. 5 to 7, relate to linings 3*d* having a uniform wall thickness, linings 3*e* having a peripherally increasing wall thickness and linings 3*f* which are thinner in the axial region m.

The trajectories of the fragments 3*c*' to 3*f*' of the respective linings 3*c* to 3*f*' on their flight into the target 20 are shown in all of the FIGS. 4 to 7, and their direction of rotation Θ is characterised by arrows.

In each case, the starting point is the ignition of the charge 4 at a distance of 2.5 to 3.0 times the calibre of the charge.

In the target 20, the fragments 3*c*' to 3*f*' pux~:i an annulus 21 having an outer diameter of 2.2 times the calibre and an inner diameter corresponding approximately to the calibre. Here, the resulting disc 22 is punched out completely.

As shown in the drawings according to FIG. 1 to FIG. 7, as seen in cross-section the front areas are continuous in the mathematical sense in all examples and their gradient (=first derivative) is within absolute values of 0.0 to 0.9. At values of greater than 0.9, the lining tends to collapse, whereupon the cutting ring disintegrates.

As a result of suitable modifications, the subject-matter of the invention can not only be adapted to numerous weapon systems but also for numerous civilian applications.

In the military sphere, amongst other things torpedoes which make use of the overcalibrated opening, for example in a ship's hull, for introducing multiple stage effective charges are conceivable. Likewise, in new weapon systems~, components such as sensors and or control electronics can be arranged in the head of the projectile without failing prematurely, themselves damaged by the preliminary charge. The effective force of the preliminary charge is not adversely affected by an arrangement of this type; the structural length of the ammunition body can be used to greater advantage and the overall ballistics improved.

In civilian applications, it is possible to realise, amongst other things, exploded openings which can be made in heavily loaded containers in the event of emergency shutdowns. Likewise, rapid flooding of tightly closed rooms, for example in the event of a fire, and also depressurisation are possible without requiring special installation of expensive seals and/or drive means. Here, the second charge can be very small, or can even be dispensed with and/or be replaced by a large calibre element, such as a pipe, a slide valve etc., which may be pushed into the bore, and these elements can be accelerated, pushed or pressed in by the small charge.

Analogous applications are likewise conceivable within the field of oil exploration and delivery and are in no way restricted to this. In each case, the subject-matter of the invention permits numerous variants and adaptations according to local conditions, and could also be used in emergencies if conventional means which are dependent on stationary auxiliary power fail.

What is claimed is:

1. A rotationally symmetrical ammunition body having a shaped preliminary charge comprising an explosive charge with a front face and a ductile metal lining having front and rear faces and which extends across the entire charge front face with an central axial region and an outwardly lying peripheral region, no portion of the peripheral region projecting forwardly of the central axial region, the lining being rotationally symmetrical about a central axis, the area of the lining front face being continuous between a periphery of the lining and the axial region, the gradient of the lining front face not exceeding an absolute value of 0.9, the ductile metal lining being constructed to form upon ignition a cutting beam of a conical hollow ring shape having a diameter no less that the original caliber of the ammunition body.

2. An ammunition body according to claim 1, characterized in that the thickness of the lining is greater in its axial region than in its peripheral region.

3. An ammunition body according to claim 1 or 2, characterized in that the lining has at least a partial spherical three-dimensional shape.

4. An ammunition body according to claim 3, characterized in that the front face of the lining has a smaller radius of curvature than its rear face.

5. An ammunition body according to claim 3, characterized in that the front face of the lining has a larger radius of curvature than its rear face.

6. An ammunition body according to claim 3, characterized in that the front face and the rear face of the lining have identical radii of curvature.

7. An ammunition body according to claim 3, characterized in that the radii of curvature of the lining front and rear faces are in a range of 0.2 to 2.0 times a calibre of the ammunition body.

8. An ammunition body according to claim 1, characterized in that the lining is at least partially delimited by linear surfaces of revolution.

9. An ammunition body according to claim 1 or 2, characterized in that inert bodies are placed in the explosive charge for guiding resulting detonation waves into the lining after initiation of the explosive charge.

10. A method for using a multi-stage rotationally symmetrical warhead having at a front end an ammunition body with a distance igniter and a preliminary charge in the form of a shaped charge having a ductile metal lining according to claim 1 or 2, comprising the steps of:

locating at least one effective charge in the warhead at a distance from the preliminary charge in a direction opposite to a launching direction of the warhead;

igniting the preliminary charge at a distance from a target of 2 to 10 times the caliber of the ammunition body; and forming a cutting beam emanating from the warhead to create in the target a bore through which at least one of the effective charges penetrates into the target body and detonating the at least one effective charge after a time delay whereby the cutting beam is of a conical ring shape having a widened leading edge to create a bore having a diameter of 1.0 to 2.2 times the caliber of the ammunition body is generated in the target such that a full caliber of the effective charge penetrates unimpeded into the target.

11. A method for combating relatively lightly armored targets, utilizing the ammunition body of claim 1 or 2.

12. A method for specific opening of poorly accessible components and formations which comprises utilizing the ammunition body of claim 1 or 2.

13. A method for specific opening, introduction and attachment of rotationally symmetrical elements in poorly accessible components and formations which comprises utilizing the ammunition body of claim 1 or 2.

* * * * *